US006602082B2

(12) United States Patent
Nishide et al.

(10) Patent No.: US 6,602,082 B2
(45) Date of Patent: Aug. 5, 2003

(54) LEVER TYPE CONNECTOR ASSEMBLY

(75) Inventors: Satoru Nishide, Yokkaichi (JP); Osamu Ito, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/147,585

(22) Filed: May 15, 2002

(65) Prior Publication Data

US 2002/0177338 A1 Nov. 28, 2002

(30) Foreign Application Priority Data

May 24, 2001 (JP) ..... 2001-155300

(51) Int. Cl.[7] ..... H01R 13/62
(52) U.S. Cl. ..... 439/157
(58) Field of Search ..... 439/157, 352, 439/353, 372, 160

(56) References Cited

U.S. PATENT DOCUMENTS 5,104,330 A * 4/1992 Yagi et al. ..... 439/157
5,230,635 A * 7/1993 Takenouchi et al. ..... 439/157
5,476,390 A * 12/1995 Taguchi et al. ..... 439/157
5,709,560 A * 1/1998 Hio ..... 439/157
6,341,968 B1 1/2002 Grant ..... 439/157
6,439,902 B1 * 8/2002 Cole et al. ..... 439/157
6,517,364 B2 * 2/2003 Muramatsu et al. ..... 439/157

* cited by examiner

*Primary Examiner*—Tho D. Ta
(74) *Attorney, Agent, or Firm*—Anthony J. Casella; Gerald E. Hespos

(57) ABSTRACT

A female housing (21) has a rear side formed with a lever pocket (25). A cover (40) has a projection (48) that can be mounted into the lever pocket (25) along with a lever (60). The lever 60 has a cantilevered elastic latch (66) with a latch projection (68) that can engage a mateable latch (49) on the projection 48. The lever (60) has an engaging projection (69) that is opposed to a release rib-advancing slot (36) and adapted to receive a releasing rib (16). When the housings (11) and (21) are coupled to each other into a given depth, the releasing rib (16) enters the slot (36) and engages the engaging projection (69). Thus, the elastic latch (66) retracts elastically toward an escape space (67) and releases a locking condition between the latch projection (68) and the mateable latch (49).

11 Claims, 14 Drawing Sheets

LEVER TYPE CONNECTOR ASSEMBLY

BACKGROUND OF THE INVENTION

1. Field of the Invention

This invention relates to a lever type connector assembly.

2. Description of the Related Art

A conventional lever type connector assembly has first and second housings that can be mated with one another. A cover is mounted to the first housing for leading electric wires out of the housing, and a lever is attached to the cover. The lever has cam grooves and the second housing has cam pins that can mate with the cam grooves. Holding means are provided for holding the lever in a coupling start position where the cam grooves in the lever can receive the cam pins prior to coupling the connector housings. The holding means are released by a releasing means at an early stage of coupling so that the lever can be turned to a coupling completion position.

A first known releasing means includes concave and convex portions formed respectively on the lever and cover. The concave and convex portions are locked with each other in the coupling start position. However, movement of the lever toward the coupling completion position forcedly releases the locking condition of the concave and convex portions. This first known releasing means increases the force required to turn the lever.

A second known releasing means includes a lever that is elastically locked with a cover in the coupling start position. A releasing portion is formed on the second housing and engages an elastic latch to release a locking condition between the lever and the cover. This second known releasing means uses a coupling operation of the second housing, and has an advantage that the turning operation of the lever becomes favorable in comparison with the first known releasing means. On the other hand, it is necessary to dispose the elastic latch within a coupling area, because the second means utilizes the coupling operation of the mateable housings.

However, the two known releasing manners cannot be used in a lever type connector assembly in which a cover is overreached from a coupling area, as disclosed, for example, in U.S. Pat. No. 6,341,968.

In view of the above problems, an object of the present invention is to provide a lever type connector assembly in which a turning operation of a lever is enhanced.

SUMMARY OF THE INVENTION

The invention is directed to a lever type connector assembly including first and second connector housings detachably coupled to each other. An attaching member is mounted to the first connector housing, and a lever with a cam groove is rotatably supported on the attaching member. Cam pins are disposed on the second connector housing for engaging the cam grooves in the lever. The connector housings are coupled to each other by turning the lever from a coupling start position to a coupling completion position. The lever type connector assembly is characterized in that the attaching member has a projection that protrudes in a coupling area in the first or second connector housing. The projection or the lever has an elastic latch in the coupling area that can restrain the lever in the coupling start position from turning to the coupling completion position by engaging the elastic latch with a mateable latch on the other of the projection and lever. The second connector housing has a release portion that releases the elastic latch from the mateable latch by engaging the release portion with the elastic latch when the second connector housing is advancing in the coupling area, thereby elastically deforming the elastic latch to disengage the elastic latch from the mateable latch.

The projection piece and the lever may be provided with release prevention means for preventing the elastic latch and the mateable latch from being displaced relative to each other in a direction that intersects a deflecting direction of the elastic latch. Thus, the elastic latch and the mateable latch are prevented from being released.

The deflecting direction of the elastic latch may be substantially parallel to a turning direction of the lever. Additionally, the release prevention means may include first and second engaging portions. The first engaging portion protrudes from the elastic latch for engaging a side surface along the deflecting direction of the projection piece or the lever on which the projection piece is provided. The second engaging portion is disposed adjacent the first engaging portion, and protrudes from the projection piece or the lever on which the mateable latch is provided for engaging a side surface along the deflecting direction of elastic latch.

The attaching member can be mounted on the first connector housing in a regular position and a reversed position, and at least two release portions are provided for engaging the elastic latch regardless of whether the attaching member is in the regular position or in the reversed position.

The lever initially is set in the coupling start position where the lever is restrained from turning to the coupling completion position by the engagement of the elastic latch and the mateable latch. As the connector housings are coupled, the cam pins advance into the cam grooves, and the releasing portion engages the elastic latch disposed in the coupling area. Thus, the elastic latch is deformed elastically to release the locking condition between the elastic latch and the mateable latch. Consequently, the lever is permitted to turn to the coupling completion position. When the lever is turned from the coupling start position to the coupling completion position, both connector housings are regularly coupled to each other by engagement of the cam pins and cam grooves.

The projection piece protruding within the coupling area is provided on the attaching member. Thus, the locking condition between the elastic latch and the mateable latch can be released by the releasing portion on the second connector housing, thereby improving the turning operation of the lever.

The release prevention means restrains the elastic latch and mateable latch from being displaced relative to each other in the direction intersecting the deflection direction of the elastic latch. Thus, it is possible to maintain the lever surely in the coupling start position, thereby smoothly effecting the successive coupling work.

Either the projection piece or the lever may be deformed in a direction intersecting the deflection direction of the elastic latch. Nevertheless, the first engaging portion engages the projection, or the lever provided with mateable latch and the second engaging portion engages the elastic latch. Thus, the other element is deformed correspondingly. Accordingly, it is possible to prevent the elastic latch and mateable latch from being displaced relative to each other and thus to prevent their locking condition from being released by mistake. Also, since the first and second engaging portions are provided on the elastic latch and projection or the lever, it is possible to make the connector assembly compact in a direction intersecting the deflection direction of the elastic latch, in comparison with a structure in which a pair of engaging portions are provided on an elastic latch and a projection piece or a lever provided with a mateable latch is pinched between both engaging portions.

It is possible to increase degree of freedom in a posture attaching the attaching member to the first connector housing.

BRIEF DESCRIPTION OF THE DRAWINGS

The foregoing and other features of the present invention will become apparent to one skilled in the art to which the present invention relates upon consideration of the invention with reference to the accompanying drawings.

DETAILED DESCRIPTION OF THE PREFERRED EMBODIMENT

Referring now to FIGS. 1 through 15, an embodiment of a lever type connector assembly in accordance with the present invention includes a male connector 10 and a female connector 20 that can be coupled to each other. Coupling surface sides of the male and female connectors 10 and 20 each are defined as a "front side" hereinafter.

Figure 1:
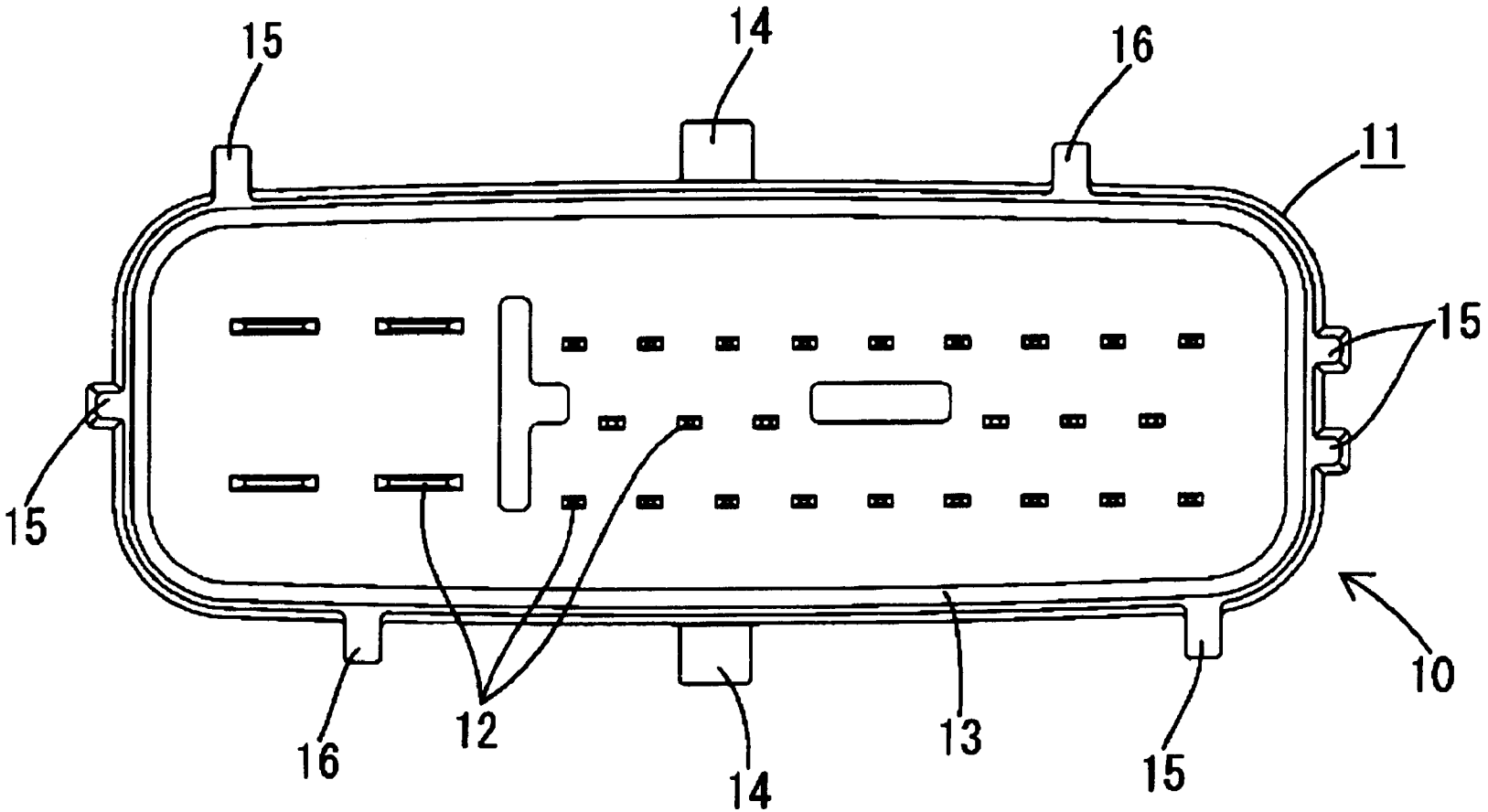
FIG. 1 is a front elevation view of a male connector of an embodiment in accordance with the present invention.
Figure 10:
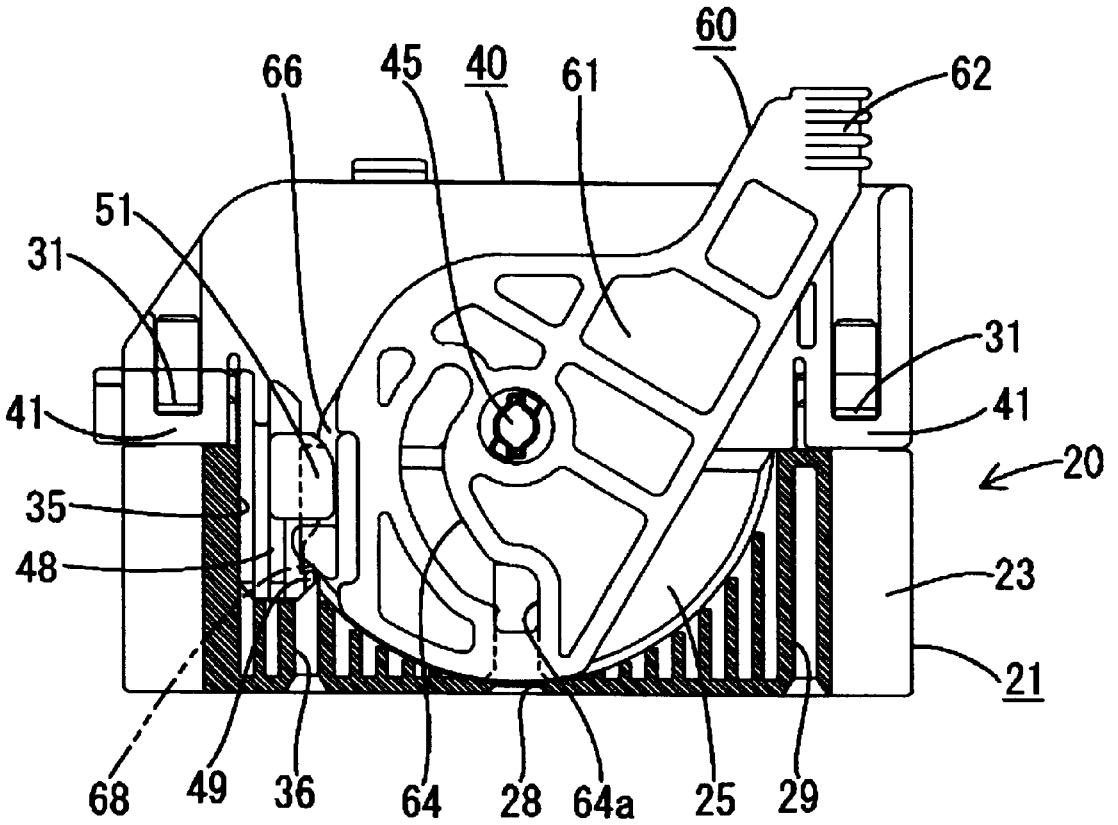
FIG. 10 is a sectional plan view of male and female connectors illustrating a state before assembling them.
Figure 10:
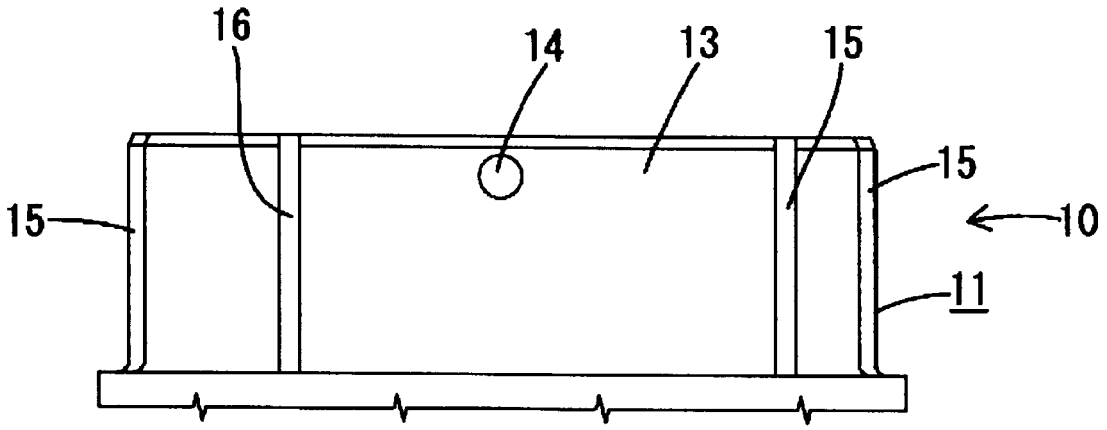

As shown in FIGS. 1 and 10, the male connector 10 includes a male housing 11 in which male tab terminals 12 are disposed. The male housing 11 has a barrel-like male hood 13 that is open at the front side. The male hood 13 surrounds the male tab terminals 12 projecting from an inner wall of the male housing 11. The male tab terminals 12 have two groups including a large size group and a small size group. The male hood 13 has a cylindrical cam pin 14 on each of upper and lower external peripheral surfaces at substantially central positions in a width direction of the male hood 13, as shown in FIG. 1. Fitting guide ribs 15 are provided on the upper left and lower right external peripheral surfaces for leading the fitting movement between the male and female connectors 10 and 20, and are disposed at the symmetrical positions with respect to a reference point in FIG. 1. Other fitting guide ribs 15 having the similar function are provided on right and left external side surfaces (one at the left side and two at the right side in FIG. 1).

Figure 3:
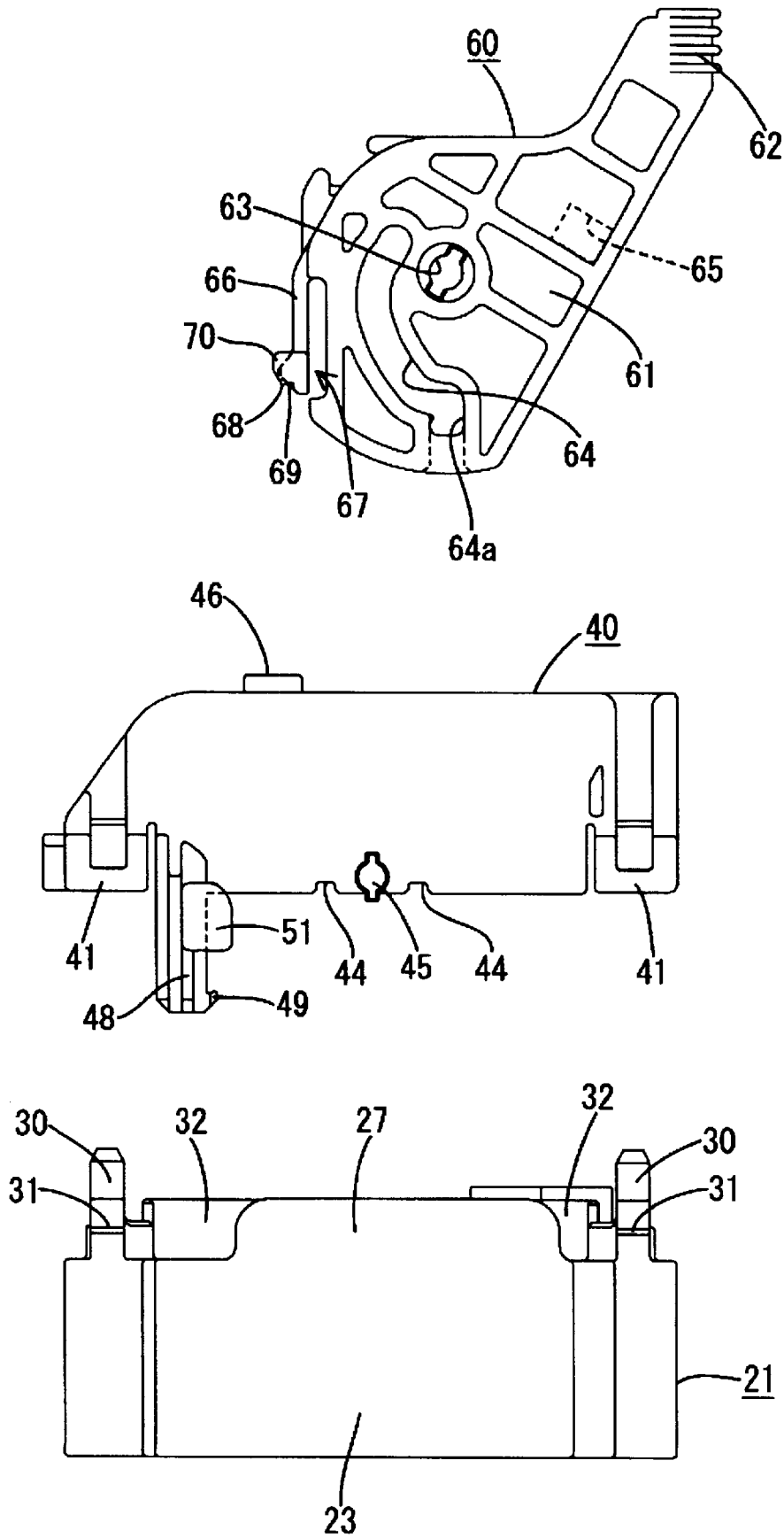
FIG. 3 is an exploded plan view of the female connector.

The female connector 20, as shown in FIG. 3, includes a female housing 21, made of a synthetic resin material, a cover 40 made of a synthetic resin material and attached to a rear side of the female housing 21, and a lever 60 made of a synthetic resin material and mounted on the cover 40.

Figure 2:
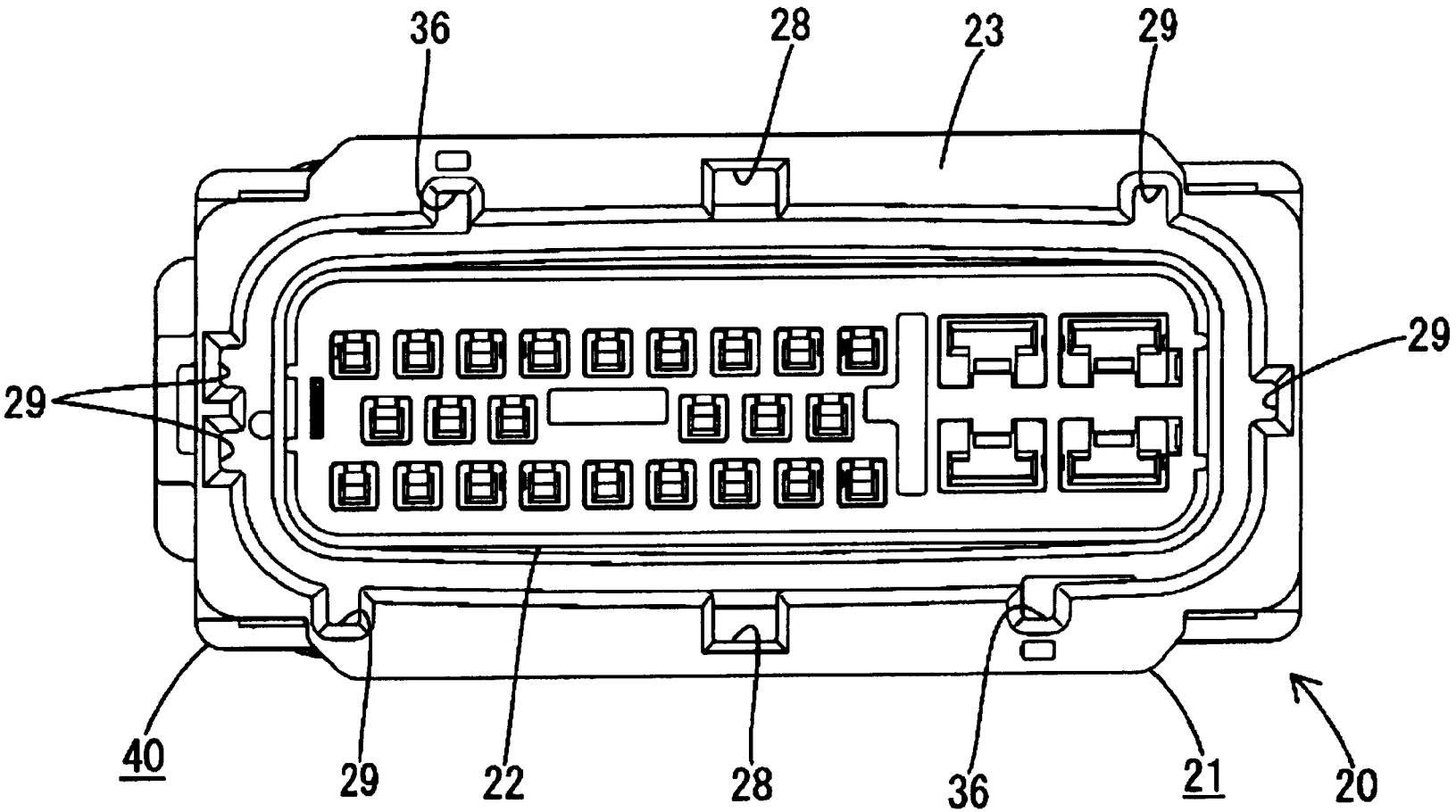
FIG. 2 is a front elevation view of a female connector.
Figure 4:
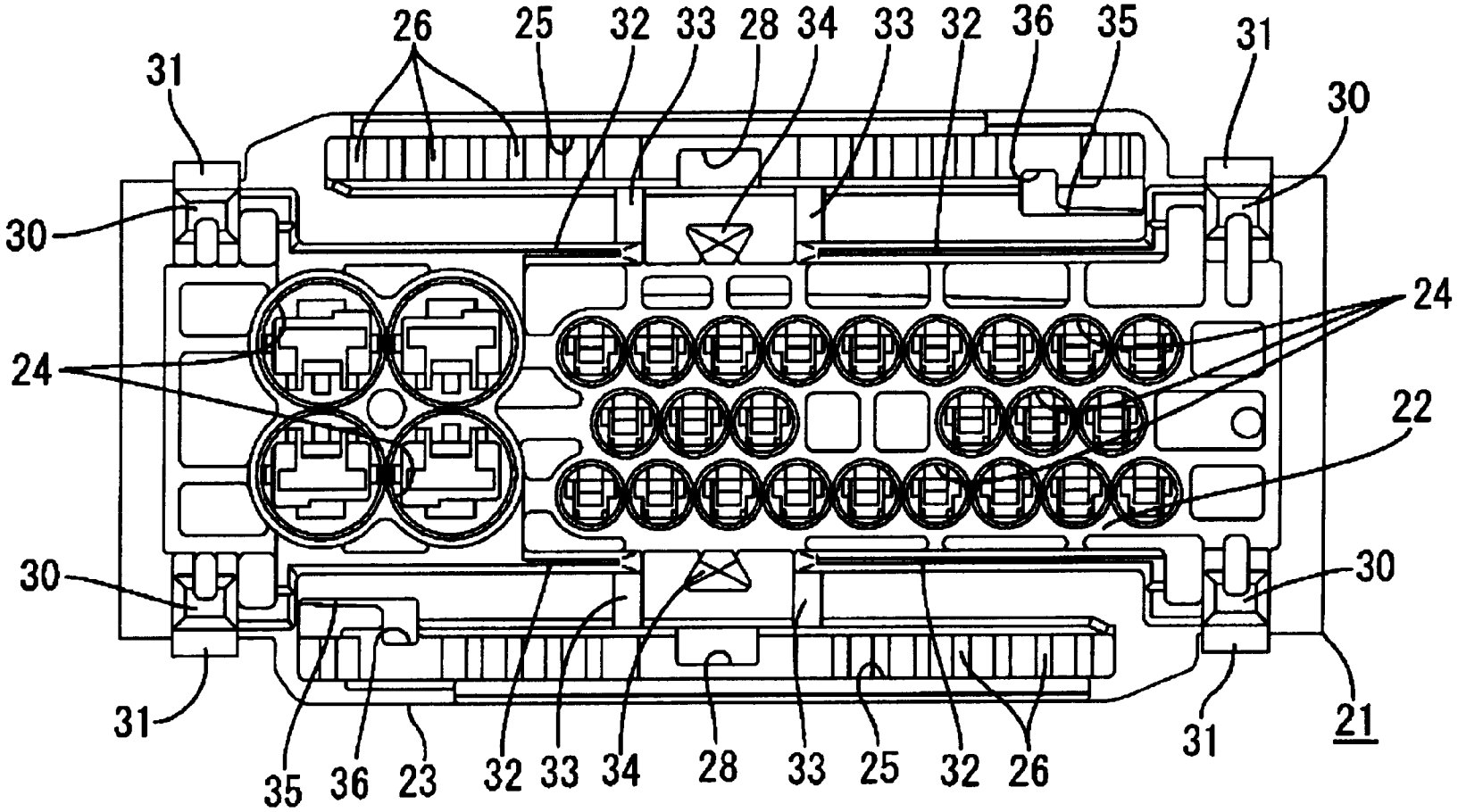
FIG. 4 is a rear elevation view of a female housing.

The female housing 21, as shown in FIGS. 2 and 4, includes a terminal-containing part 22 for accommodating large and small female terminals (not shown) and a barrel-like female hood 23 coupled to a rear end of the terminal-containing part 22 to surround the part 22. The male hood 13 of the male housing 11 can enter a space defined between the terminal-containing part 22 and the female hood 23. The terminal-containing part 22 has large and small cavities 24 in positions corresponding to the male tab terminals 12 in the male connector 10. The cavities 24 accommodate the respective large and small female terminals, which are connected to ends of electric wires.

Figure 8:
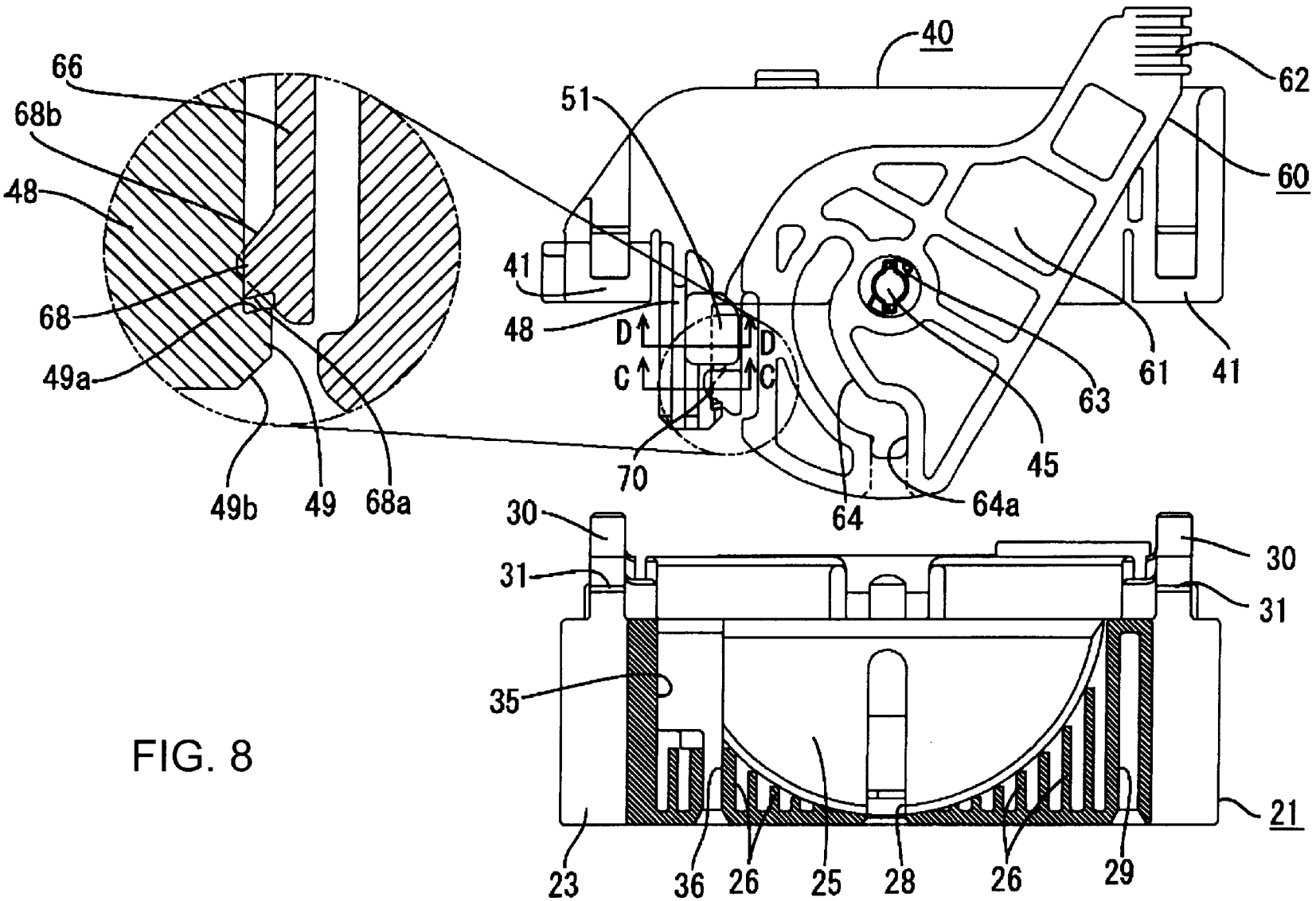
FIG. 8 is a sectional plan view illustrating the cover and female housing that mount the lever at a coupling start position.
Figure 9A:
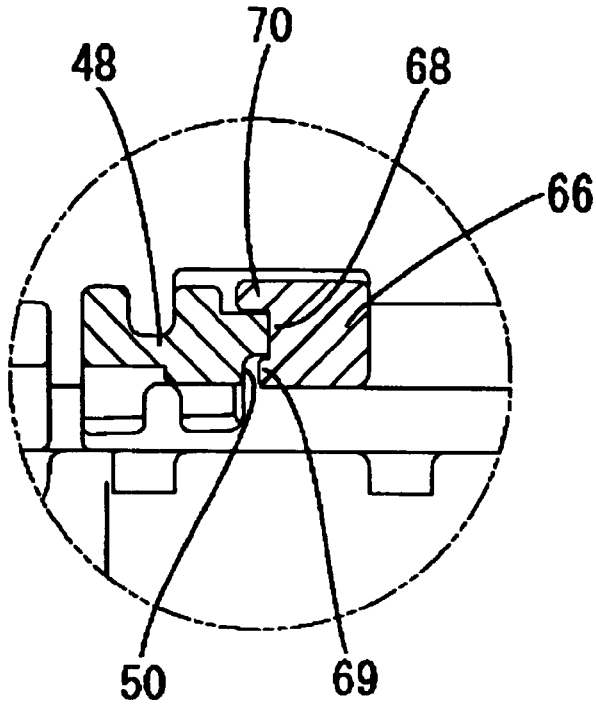
FIG. 9(A) is a sectional view taken along line C—C in FIG. 8.
Figure 9B:
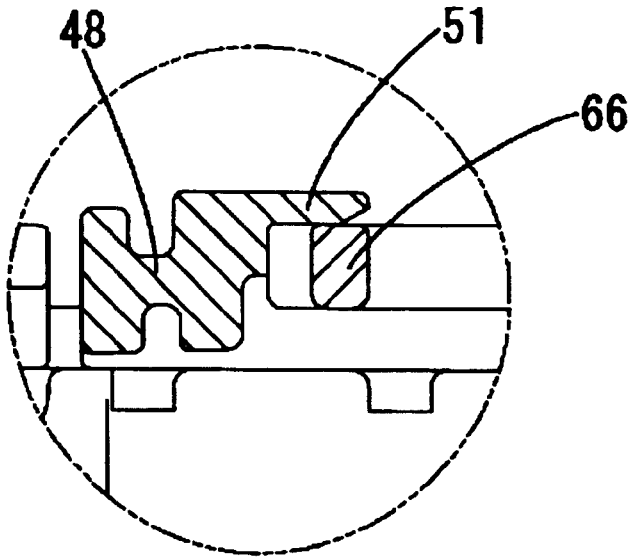
FIG. 9(B) is a sectional view taken along line D—D in FIG. 8.

As shown in FIG. 4, the female hood 23 is formed into a bag-like shape that is opened rearward in its longitudinal direction, and is provided in the interior with lever-containing pockets 25 for receiving arms 61 of the lever 60 through the rear end. Each of the arms 61 to be inserted into the lever-containing pockets 25 is disposed between inner and outer walls defining the female hood 23. As shown in FIG. 8, the lever-containing pocket 25 is formed into substantially a semi-circular shape along a turning track of the lever 60. Portions outside the lever-containing pockets 25 in the inner and outer walls of the female hood 23 are coupled to reinforcement ribs 26, thereby reinforcing the outside portions. An extending wall 27 is formed on the outer wall of the female hood 23 in a height direction, as shown in FIGS. 3 and 4, and covers each of the turning axle portions of the lever 60.

As shown in FIG. 2, two cam pin advance grooves 28 are provided on the middle positions of the front end of the female hood 23 in the width direction so that the grooves open forward and have a given depth. Five fitting-guide grooves 29 are formed on an upper right end an a lower left end in FIG. 2, and right and left side surfaces in FIG. 2 on the inner surface of the female hood 23 for receiving the fitting-guide ribs 15 on the male connector 10.

As shown in FIG. 4, a substantially square pillar-like cover attachment part 30 projects rearward on each of four corners on the rear end of the female housing 21 to attach the cover 40 to the female housing 21. A latch projection 31 is provided on an outer surface of each cover attachment part 30 for engagement with latch arms 41 of the cover 40. Right and left guide plates 32 are provided on the outer surface of the cavities 24 in the rear end of the female housing 21. The guide plates 32 can slide on ridges 42 formed on the interior of the cover 40. A substantially triangular lever guide 33 is formed on an inner end of each guide plate 32 in the width direction. A ramp of the lever guide 33 is connected continuously to each of the lever-containing pockets 25, so that the arms 61 can smoothly enter the lever-containing pockets 25. A pair of square pillar-like positioning ridges 34 are provided between the lever guides 33 so that the ridges 34 can fit in positioning grooves 43 in the cover 40.

Figure 5:
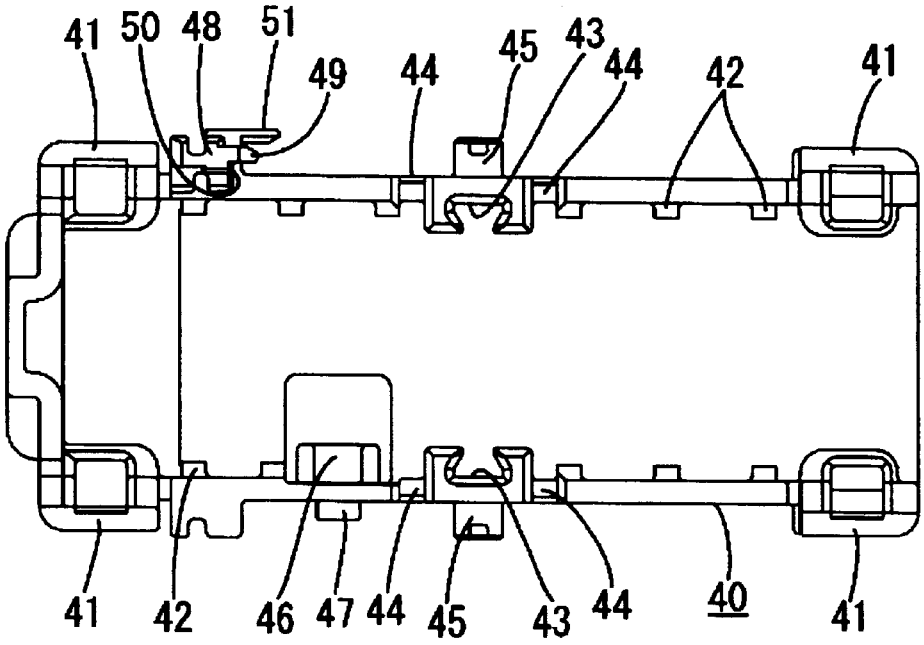
FIG. 5 is a rear elevation view of a cover.

As shown in FIGS. 3 and 5, the cover 40 is formed into a substantially box-like configuration in which a front surface and one of the opposite side surfaces are open. The open front end of the cover 40 is attached to the female housing 21 to cover the rear end of the female housing 21. Electric wires (not shown) led out from the rear end of the female housing 21 are bundled, bent within the cover 40 at an angle of about 90 degrees and led out from the side opening in the cover 40.

Four channel-shaped latch arms 41 are formed on opposite longitudinal ends of the cover 40. Each latch arm 41 is elastically deformable sufficiently to ride on the cover attachment part 30. Thus, each latch arm 41 can engage each latch projection 31 elastically. Ridges 42 are formed on the inner surface of the cover 40 to slide on the guide plates 32. Positioning grooves 43 are formed in upper and lower middle portions of the inner surface of the cover 40 in the width direction so that the positioning ridges 34 engage the grooves 43 to position the cover 40 with respect to the female housing 21. An escape portion 44 is provided on each of the opposite sides of the positioning grooves 43 to permit escape of the lever guide 33. The structure for holding the cover 40 and female housing 21 is symmetrical with the lateral centerline in FIGS. 4 and 5. Thus, the cover 40 can be attached to the female housing 21 in either a regular position or a reversed position. Accordingly, it is possible to set a direction of drawing the electric wires in either a right direction or a left direction by selecting the attachment posture of the cover 40.

Support axles 45 are formed on the middle front ends on the outer surface of the cover 40, with respect to the width direction of the cover 40, for engaging axle holes 63 in the lever 60. Each support axle 45 is cylindrical, but has front and rear projections. A holding arm 46 is cantilevered from a left position of the lower wall of the cover 40, as shown in FIG. 5. The holding arm 46 is elastically deformable in a height direction and protrudes its free end outwardly. A holding projection 47 is formed on the outer surface of the holding arm 46.

Figure 6:
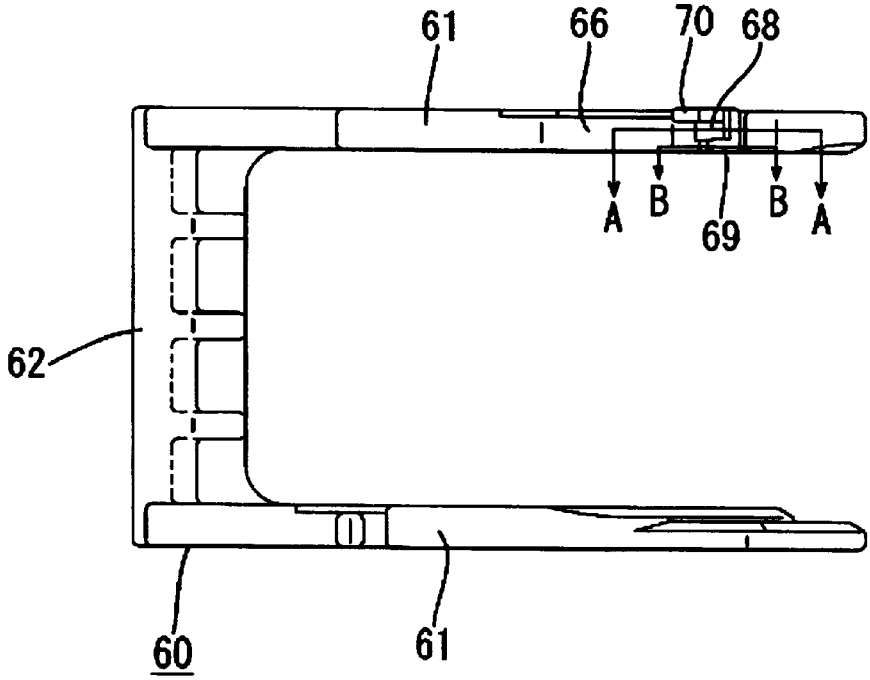
FIG. 6 is a side elevation view of a lever.

As shown in FIGS. 3 and 6, the lever 60 includes a pair of arms 61 and an operating portion 62 that couples the arms 61. The lever 60 is attached to the cover 40 so that the cover 40 is disposed between the arms 61. More particularly, an axle hole 63 is provided substantially in a middle position of each arm 61 for engaging the support axle 45 of the cover 45. The support axles 45 are fitted in the axle holes 63 so that the lever 60 is rotatably supported on the cover 40. The arms 61 always extend forward from the front-end of the cover 40 in the attachment condition. The lever 60 can be turned from a coupling start position shown in FIG. 10 to a coupling completion position shown in FIG. 15.

As shown in FIG. 3, a cam groove 64 is formed in each arm 61 so that the cam groove 64 receives the cam pin 14 on the male connector 10. The cam groove 64 has a forwardly open straight inlet 64*a* and an involute portion that gradually approaches the axle hole 63 as the groove 64 extends from the inlet 64*a*. When the lever 60 is in the coupling start position, as shown in FIGS. 8 and 10, the inlet 64*a* in the cam groove 64 is directed to a front surface to permit the cam pin 14 to enter the inlet 64*a*. At this time, the side edge of the operating portion 62 can engage the rear end of the cover 40, so that the lever 60 is restricted from turning in the direction opposite to the coupling completion position.

Figure 14:
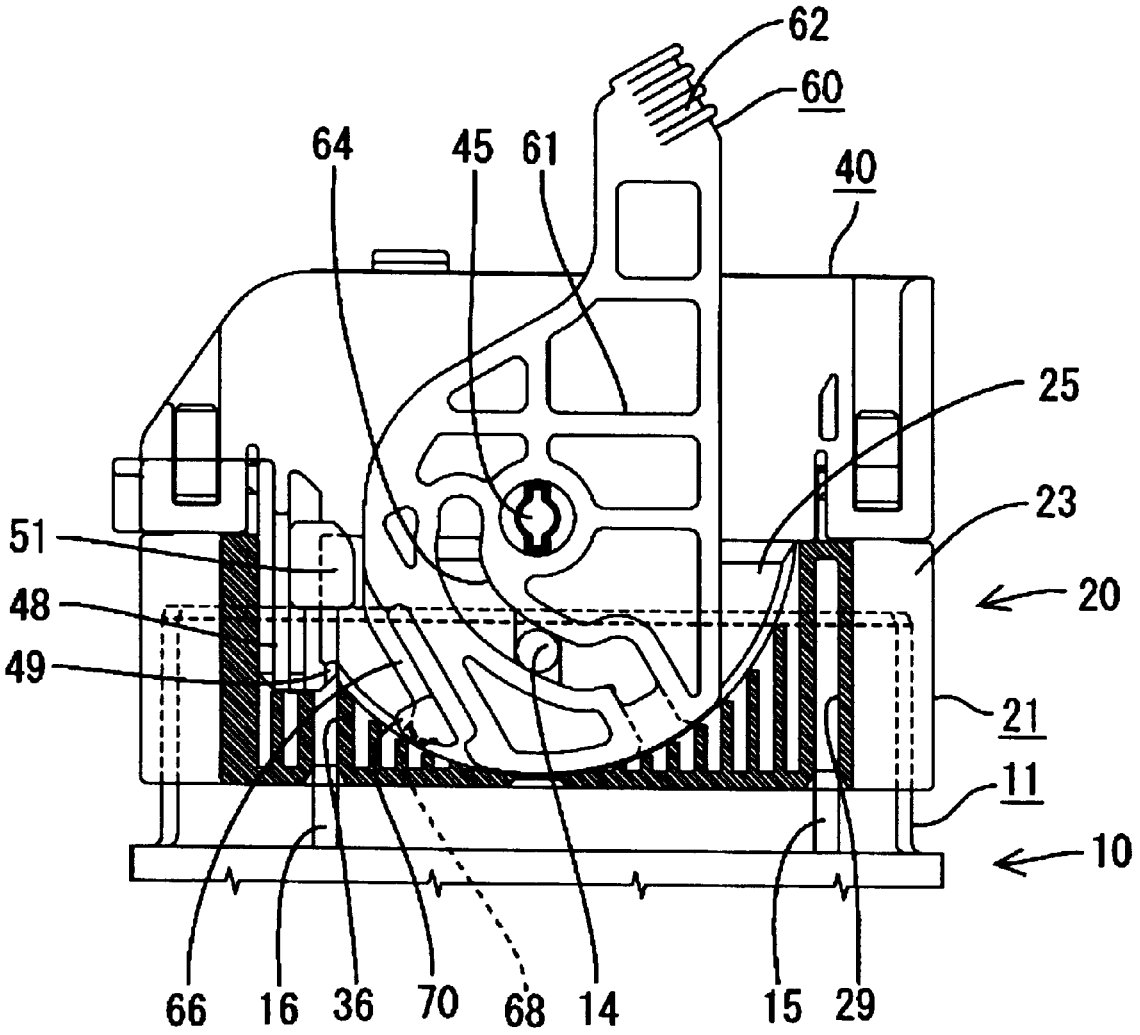
FIG. 14 is a sectional plan view of the male and female connectors illustrating a state in which the lever is being turned toward a coupling completion position.

As the lever 60 is turned from the position where the cam pin 14 enters the cam groove 64 toward the coupling completion position, engagement of the cam pins 14 with the cam grooves 64 draws the male connector 10 into the female connector 20 (see FIG. 14). When the lever 60 reaches the coupling completion position, the connectors 10 and 20 are coupled to each other in a regular depth (see FIG. 15). The outer arm 61 of the lever 60 in FIG. 3 is provided with a holding hole 65 that receives the holding projection 47 of the cover 40 when the lever 60 reaches the coupling completion position. Engagement of the holding projection 47 with the holding hole 65 prevents the lever 60 from turning from the coupling completion position.

The female connector 20 has holding means for holding the lever 60 in the coupling start position, and the male connector 10 has releasing means for releasing the holding condition. The holding means include an elastic latch 66 on the lever 60 and a projection 48 with a mateable latch 49 that is able to engage the elastic latch 66. The releasing means include a releasing rib 16 provided on the male housing 11 in the male connector 10 and able to engage the elastic latch 66.

More specially, the elastic latch 66 is cantilevered from the left side of the inner arm 61 in FIG. 3. Additionally, the elastic latch 66, as shown in FIG. 8, is disposed so that its proximal end is substantially aligned with the front end of the cover 40 when the lever 60 is in the coupling start position and the free end of the elastic latch 66 extends straight forward in parallel to the projection 48 of the cover 40. The elastic latch 66 can be deformed elastically along a direction substantially parallel to the turning direction of the lever 60 about the proximal end of the elastic latch 66 and can be retracted into an escape space defined between the elastic latch 66 and a body of the arm 61 to separate from the projection 48.

Figure 7A:
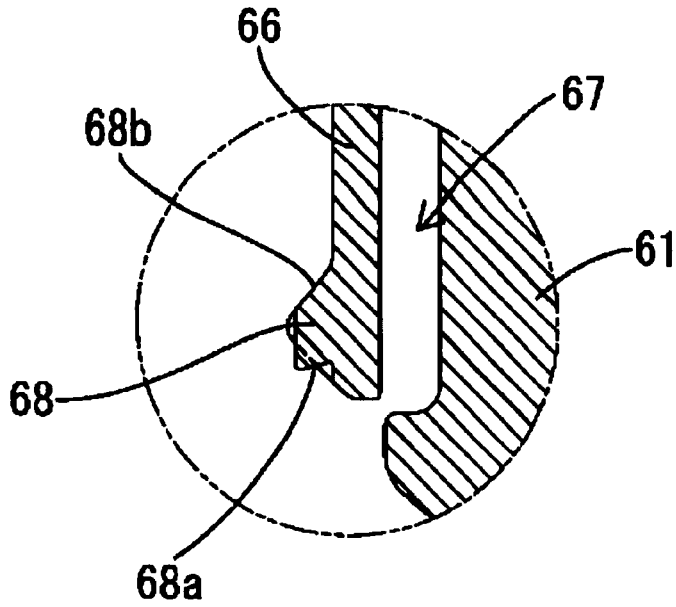
FIG. 7(A) is a sectional view taken along line A—A in FIG. 6.
Figure 7B:
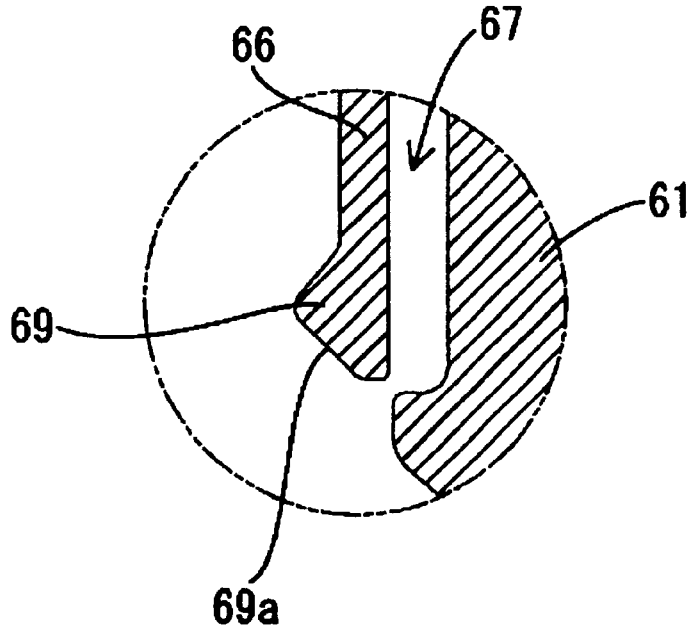
FIG. 7(B) is a sectional view taken along line B—B in FIG. 6.

As shown in FIGS. 3 and 6, a latch projection 68 and an engaging projection 69 are displaced from each other at inner and outer positions in a height direction on the side edge of the projection 48 on the distal end of the elastic latch 66. The latch projection 68, as shown in FIG. 7(A), defines an overhang that extends toward the projection 48 at the projection end side. A slanted front surface 68*a* of the latch projection 68 can engage a rear surface 49*a* of the mateable latch 49 of the projection 48. The front surface 68*a* of the latch projection 68 forms an acute angle with respect to the side surface of the elastic latch 66. On the contrary, the rear surface 68*b* of the latch projection 68 forms a gentle ramp at an obtuse angle to the side surface of the elastic latch 66. On the other hand, the engaging projection 69, as shown in FIG. 6, is disposed on an inner side in the height direction with respect to the latch projection 68 to engage the releasing rib 16 on the male connector 10. The engaging projection 69, as shown in FIG. 3 and FIG. 7(B), is formed into a triangular configuration. The releasing rib 16 is guided on the slanted front surface 69*a* from the engaging position to the position where the elastic latch 66 retracts within the escape space 67 as the releasing rib 16 moves forward relative to the surface 69*a*. The front surface 69*a* of the engaging projection 69 forms an obtuse angle with respect to the side surface of the elastic latch 66.

The projection 48 is disposed on left side of the lever 60 on the front sidewall of the cover 40 in FIG. 3 to project forward in parallel to the elastic latch 66. As shown in FIG. 5, the projection 48 is formed substantially into an H-shape. The mateable latch 49 is on the side of the front end of the projection 48 towards the elastic latch 66 so that the projection 68 protrudes towards the projection 48 to engage the mateable latch 49. The mateable latch 49, as shown in FIGS. 3 and 5, forms an overhang that projects gradually toward the projecting end side. A slanted rear surface 49*a* of the mateable latch 49 is able to engage the front surface 68*a* of the latch projection 68. The rear surface 49*a* of the mateable latch 49 has an acute angle relative to the side surface of the projection 48 while the front surface 49*b* of the mateable latch 49 has an obtuse angle relative to the side surface of the projection 48. As shown in FIG. 5, an escape groove 50 for the escape of the engaging projection 69 and the releasing rib 16 is provided on the lower side of the mateable latch 49 of the projection 48.

As shown in FIG. 10, the projection 48, the arms 61 and the elastic latch 66 are inserted into the lever-containing pocket 25, and are disposed within a coupling area in the female housing 21 (an area that the male housing 11 enters when coupling) as the cover 40 is mounted on the female housing 21. Rearwardly open projection advance grooves 35 are provided in the female hood 23 of the female housing 21 to permit the projection 48 to advance. The projection advance grooves 35 are arranged in symmetry about a point. Consequently, the projection 48 is permitted to enter the lever-containing pocket 25, regardless of whether the cover 40 is at the regular attachment position or the reverse attachment position.

The elastic latch 66 and projection 48 have means for preventing the latch projection 68 and the mateable latch 49 from being released by mistake. More specially as shown in FIG. 8, a first engaging wall 70 (see FIG. 9(A)) is provided on the front outer end of the elastic latch 66 (outward from the latch projection 68 in the height direction) so that the wall 70 protrudes toward the projection 48 of the cover 40 and can engage the front outer end of the projection 48 (an outer surface along the deflecting direction of the elastic latch 66). The first engaging wall 70 is a plate that extends sideward further from the latch projection 68 and engaging projection 69. On the other hand, a second engaging wall 51 (see FIG. 9(B)) is provided on the rear outer end of the projection 48 than the mateable engaging portion of the first engaging wall 70 so that the second engaging wall 51 protrudes toward the lever 60 and can engage the rear outer end of the elastic latch 66 (an outer surface along the deflecting direction of the elastic latch 66). The second engaging wall 51 is adjacent the first engaging wall 70 to cover the entire width (including the proximal end) of the elastic latch 66. When the elastic latch 66 is displaced inward in the height direction, the first engaging wall 70 pushes the projection 48, thereby displacing the projection 48 inward. On the contrary, when the projection 48 is displaced inward in the height direction, the second engaging wall 51 pushes the elastic latch 66, thereby displacing the elastic contact latch 66 inward (see FIG. 9). Thus, the elastic latch 66 and projection 48 are prevented from moving relative to each other in a direction perpendicular to the deflecting direction of the elastic latch 66 (a turning direction of the lever 60).

Figure 13:
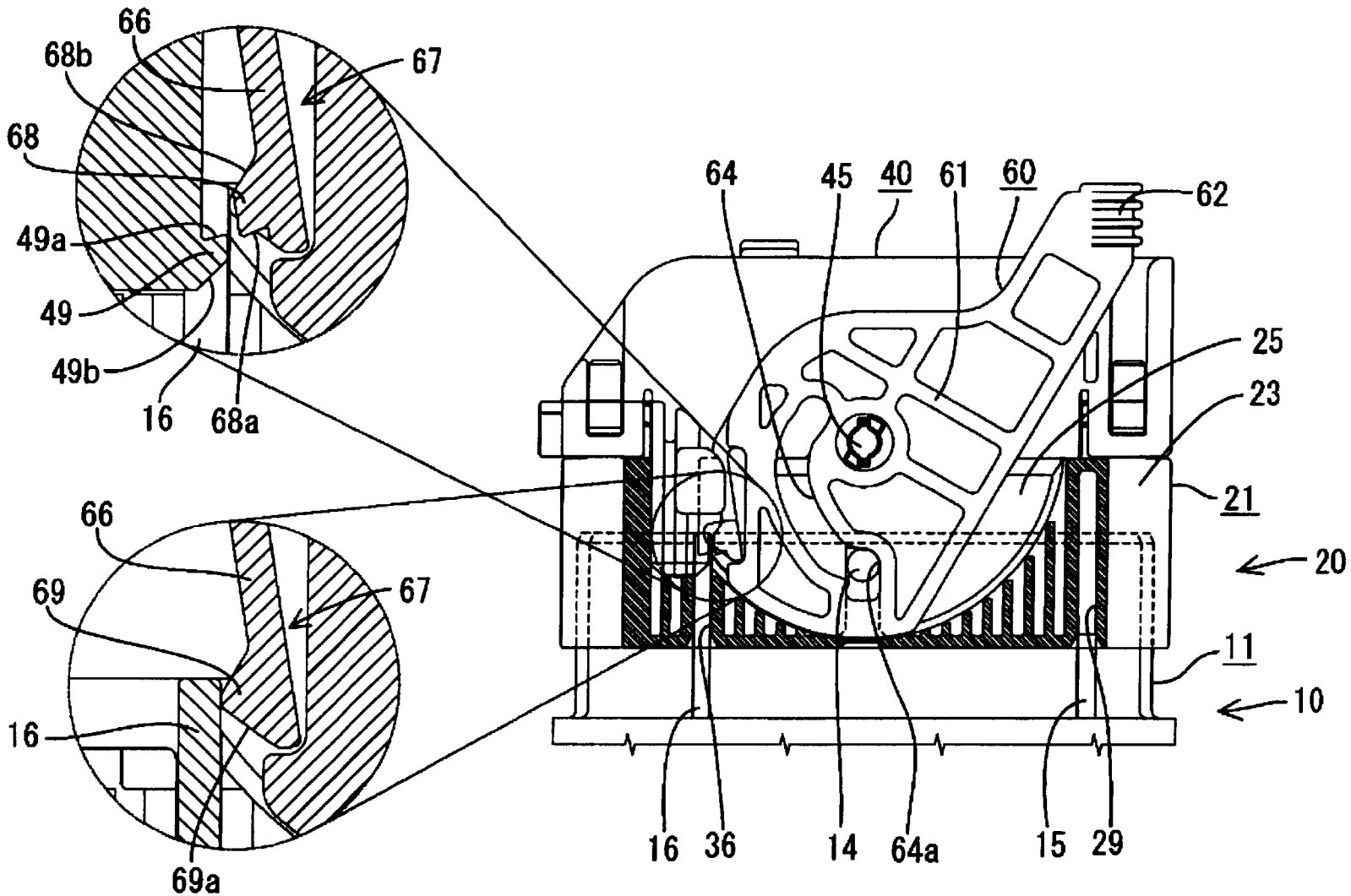
FIG. 13 is a sectional plan view of the male and female connectors illustrating a state in which the latch projection is released from the mate latch portion.

As shown in FIG. 1, releasing ribs 16 are provided on the outer peripheral surface of the male hood 13 of the male housing 11, and extend straight over the entire length of the male hood 13. As shown in FIG. 2, the female housing 21 has release rib advance grooves 36 that open forward and communicate with a rear projection piece advance groove 35 so that the releasing rib 16 can advance into the lever-containing pocket 25 when both connectors 10 and 20 are interconnected. When the male housing 11 is coupled to the female housing 21 to a depth sufficient to cause the cam pins 14 to be inserted into the inlets 64*a* of the cam grooves 64, as shown in FIG. 13, the releasing ribs 16 enter the release rib advance grooves 36 and lever containing pocket 25 and engage a front surface 69*a* of an engaging projection 69 of the elastic latch 66, so that the elastic latch 66 elastically deforms and releases the locking condition between the latch projection 68 and the mateable latch 49. Both releasing ribs 16 are disposed in symmetry about a point on the male hood 13 in FIG. 1, so that the releasing ribs 16 can engage the engaging projection 69 of the elastic latch 66 opposed to either release rib advance groove 36 even if the cover 40 is in an inverted attachment position with respect to the female housing 21.

Upon assembling the female connector 20, both arms 61 pinch the cover 40. The support axles 45 then are fitted in the axle holes 63, and the lever 60 is turned to the coupling start position. In this coupling start position, as shown in FIG. 8, the front surface 68*a* of the latch projection 68 of the elastic latch 66 engages the rear surface 49*a* of the mateable latch 49 of the projection 48. Consequently, if the lever 60 is turned towards the coupling completion position, the overhanging latch projection 68 and male latch 49 progress their locking condition and the elastic latch 66 is pulled to the opposite side of the escape space 67, thereby enhancing a clamping force of the lever 60. At this time, the engaging projection 69 enters the escape groove 50. Even if an external force for deforming the elastic latch 66 or the projection 48 in the height direction (a direction intersecting the deflecting direction of the elastic latch 66), as shown in FIG. 9, the first engaging wall 70 and the second engaging wall 51 engage the projection 48 in the elastic latch 66, thereby preventing the latch projection 68 and mateable latch portion 49 from being displaced from each other in the height direction and thus positively preventing the locking condition from being released by mistake.

Female terminals connected to the electric wires are accommodated in the cavities 24 in the female housing 21. Thereafter, as shown in FIG. 10, the cover 40, on which the lever 60 is mounted, is attached to the female housing 21 from its rear side. At this time, the electric wires led out from the rear side surface of the female housing 21 are bundled together and bent about 90 degrees while each latch arm 41 of the cover 40 engages each latch projection 31 of the cover attachment part 30, thereby maintaining the cover 40 in the attaching condition. The opening in the cover 40 is directed to the left side in FIG. 10 in the attaching condition of the cover 40 to draw the electric wires in the same direction. However, the cover 40 may be turned back to the reversed position to draw the electric wires in the opposite direction (right side in FIG. 10).

Figure 11:
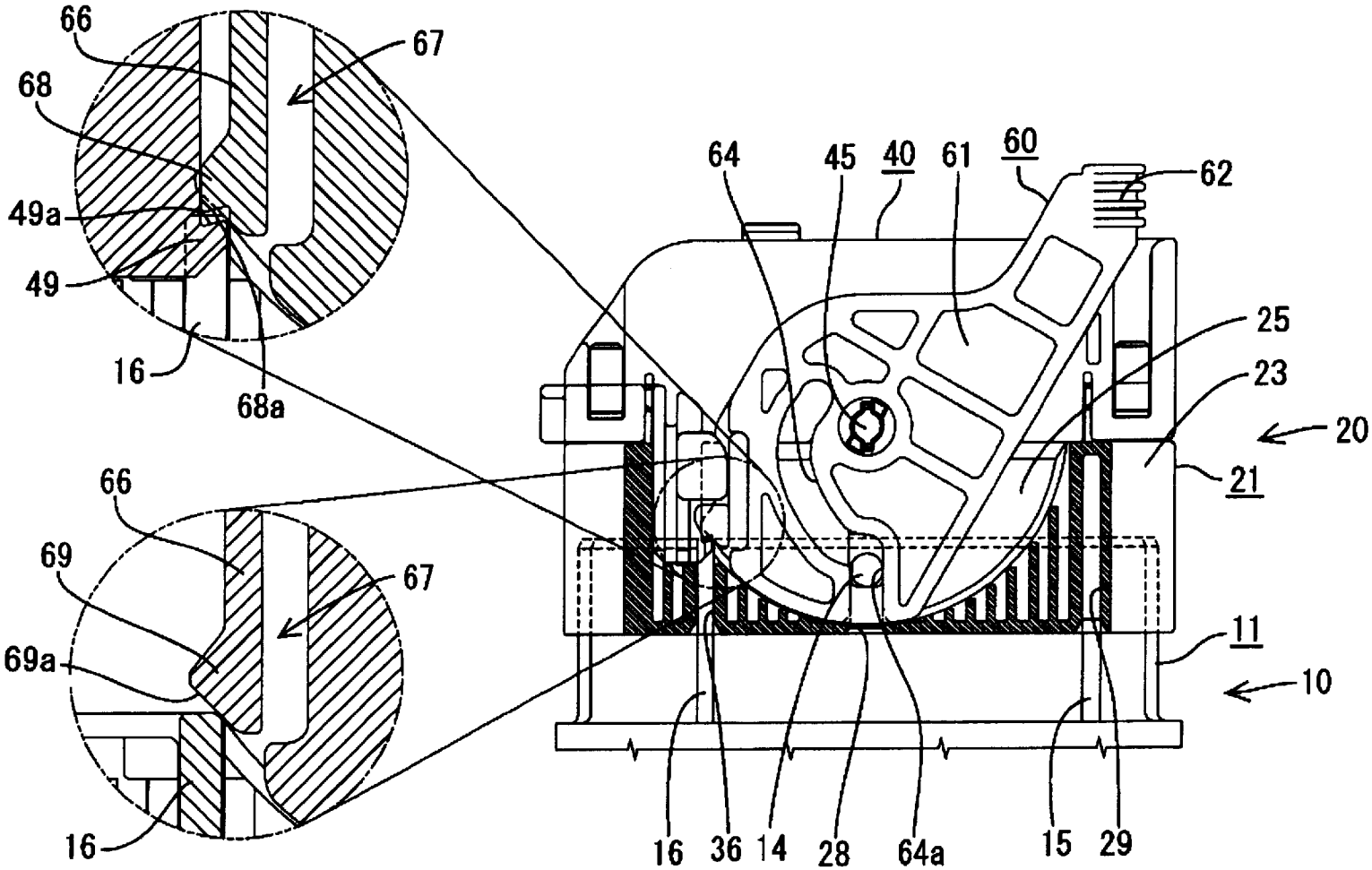
FIG. 11 is a sectional plan view of the male and female connectors illustrating a state in which a release rib engages a latch projection.
Figure 12:
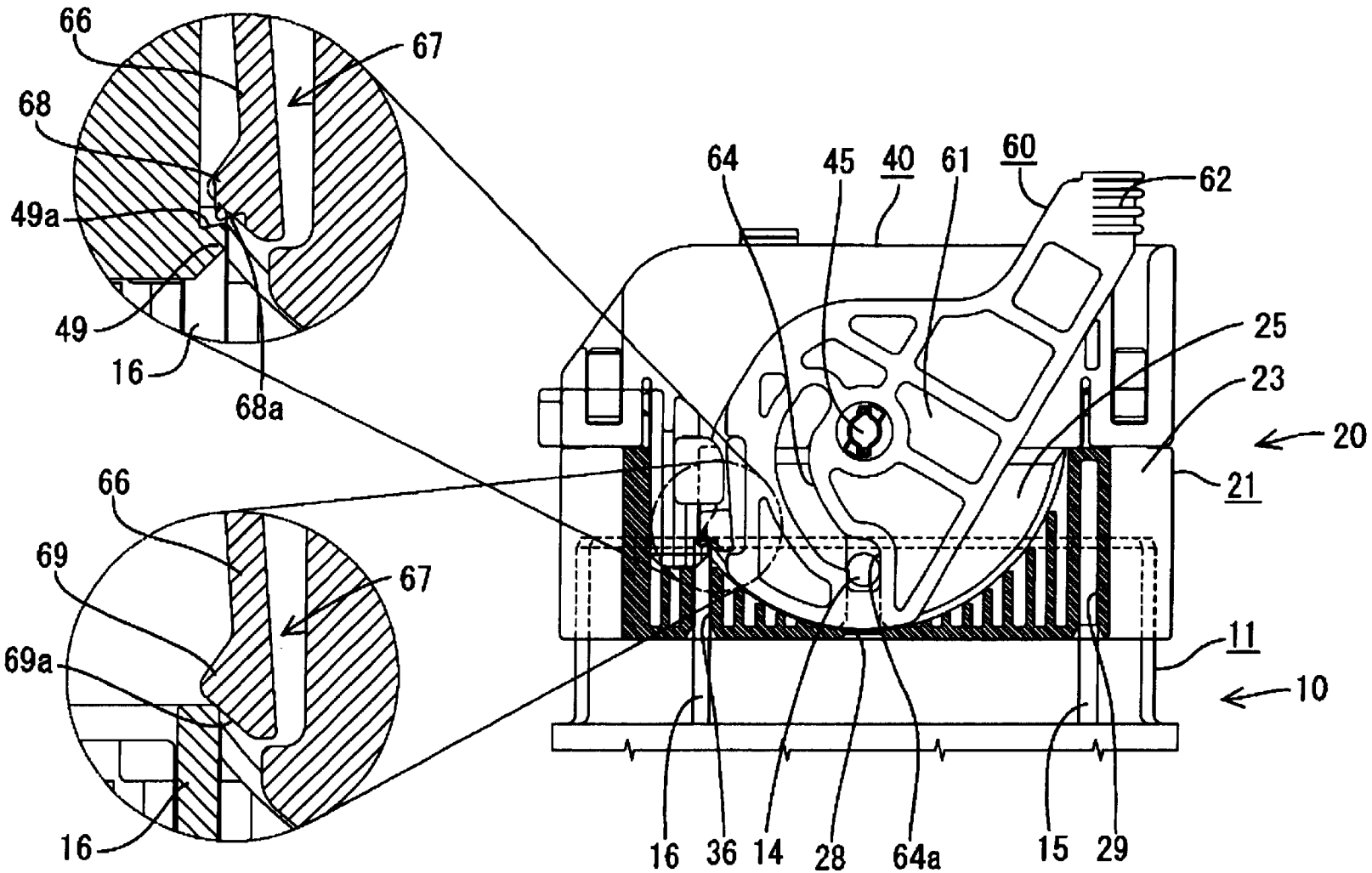
FIG. 12 is a sectional plan view of the male and female connectors illustrating a state in which the latch projection is being released from a mate latch portion.

The male and female connectors 10 and 20 are coupled to each other by fitting the male hood 13 of the male housing 11 from the front side into the space defined between the terminal-containing part 22 of the female housing 21 and the female hood 23. Thus, each guide rib 15 advances into each fitting guide groove 29, each releasing rib 16 advances into each release rib advance groove 36, and each cam pin 14 advances into the inlet 64*a* of each cam groove 64 through each cam pin advance groove 28. When they are fitted to a given depth, the releasing rib 16, as shown in FIG. 11, advances into the lever containing pocket 25 and the escape groove 50 and engages the front surface 69*a* of the engaging projection 69 of the elastic latch 66. As the fitting condition progresses further, as shown in FIG. 12, the elastic latch 66 is pushed by the releasing rib 16 engaging the engaging projection 69, so that the elastic latch 66 retracts into the escape space 67 while being elastically deformed. When both housings 11 and 21 reach a sufficient coupling depth, the cam pins 14 contact the rear ends of the inlet portions 64*a* of the cam grooves 64, as shown in FIG. 13, and the elastic latch 66 is deformed elastically to the position where the latch projection 68 is completely separated from the mateable latch 49 to release the latch projection 68 from the mateable latch 49. Thus, the lever 60 is released from the coupling start position.

Figure 15:
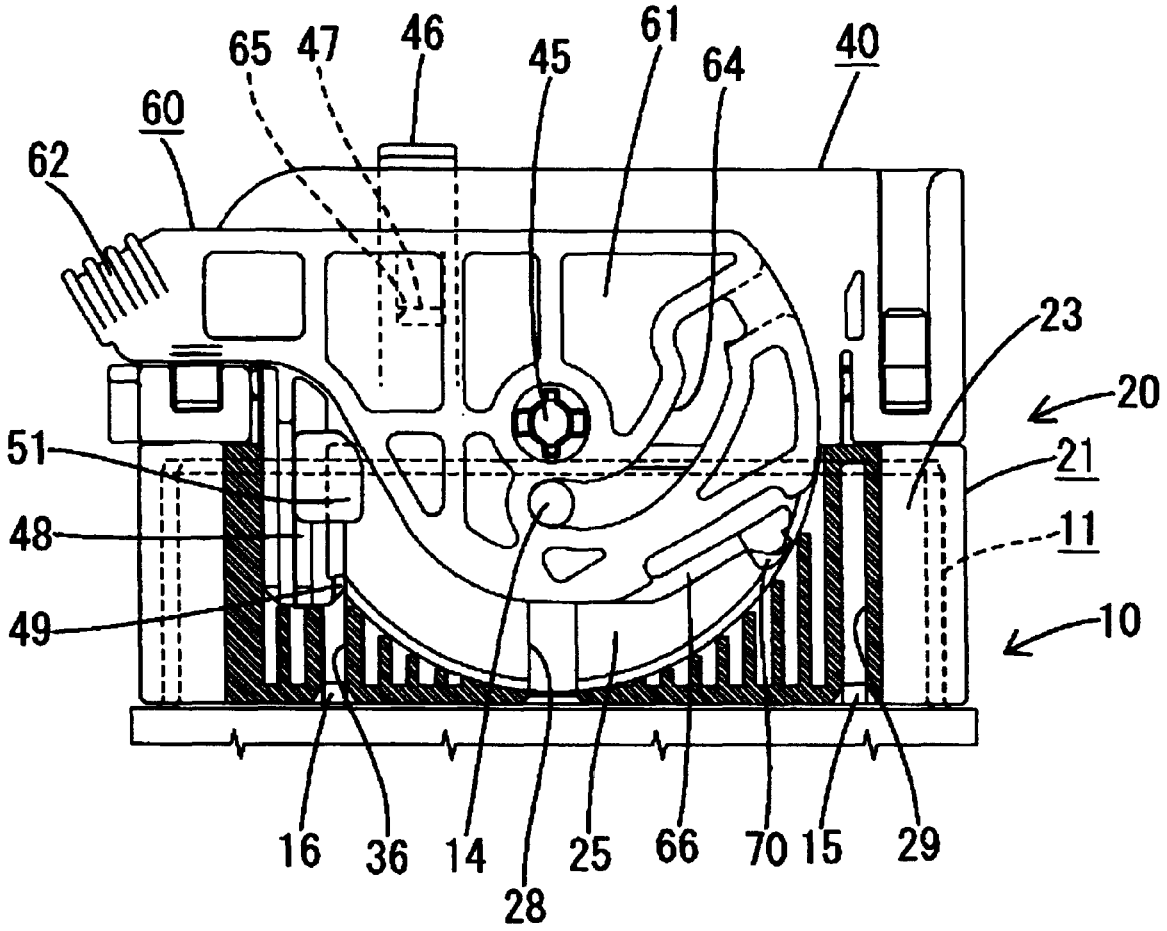
FIG. 15 is a sectional plan view of the male and female connectors illustrating a state in which the lever is turned to the coupling completion position.

The lever 60 then is turned from the coupling start position to the coupling completion position. As the lever 60 is turned, as shown in FIG. 14, engagement of the cam pin 14 with the cam groove 64 causes the male housing 11 to be pulled into the female housing 21. During this process, the elastic latch 66 is released from the releasing rib 16 and returns elastically to the original position. When the lever 60 reaches the coupling completion position, as shown in FIG. 15, both housings 11 and 21 are coupled to each other to the regular depth to regularly connect the male and female terminals. At this time, the holding projection 47 enters the holding hole 65 in the lever 60 to engage the edge of the hole, so that the lever 60 is maintained and will not turn from the coupling completion position.

The connectors 10 and 20 may be disconnected from each other on account of maintenance or the like, by turning the lever 60 from the coupling completion position to the coupling start position. During the process in which the lever 60 is turned to the coupling start position, the slanted rear surface 68*b* on the latch projection 68 engages the mateable latch 49. Thus, the elastic latch 66 deflects into the escape space 67 until the lever 60 reaches the coupling start position. The elastic latch 66 then is recovered by its elastic nature to lock the front surface 68*a* of the latch projection 68 with the rear surface 49*a* of the mateable latch 49.

The projection 48 of the cover 40 extends within the coupling area is provide on the cover 40, and thus the releasing rib 16 of the male connector 10 can release the locking condition between the latch projection 68 of the elastic latch 66 and the mateable latch 48. As a result, the holding force of the lever 60 in the process prior to coupling is enhanced and the turning operation of the lever 60 is improved.

In addition, since the first engaging wall 70 and second engaging wall 51 can engage the projection piece 48 on the outer surface in the height direction of the elastic latch 66, it is possible to prevent the latch projection 68 of the elastic latch 66 and the mateable latch 49 from displacement relative to each other in the direction intersecting the deflection direction of the elastic latch 66, thereby preventing the erroneous release of the locking condition between the portion 49 and the projection 68. Since the first and second engaging walls 70 and 51 are provided on the elastic latch 66 and projection 48, respectively, it is possible to make the connector assembly compact in the direction intersecting the deflection direction of the elastic latch 66 in comparison with the structure in which a pair of engaging walls are formed on an elastic latch and a projection is pinched between the engaging walls.

The cover 40 can be attached to the female housing 21 in either a regular position or reversed position and a pair of releasing ribs 16 are disposed on the male housing 11 in symmetry about a point. Therefore, the releasing rib 16 can engage the engaging projection 69 of the elastic latch 66 in either position of the cover 40, and it is possible to set a direction of drawing the electric wires.

It should be noted that the present invention is not limited to the above embodiments stated in the descriptions and illustrated in the drawings. For example, the following examples should be included in the technical scope of the present invention. The embodiments except for the following embodiments can be carried out by applying various modifications without departing from the gist of the present invention.

The elastic latch is provided on the lever and the mateable latch is provided on the projection piece in the embodiment described above. However, the elastic latch may be provided on the projection and the mateable latch may be provided on the lever.

Although the deflection direction of the elastic latch is parallel to the turning direction of the lever in the embodiment described above, the present invention can include a structure in which the deflection direction of the elastic latch may be in the height direction perpendicular to the turning direction of the lever. In such alternation, release prevention means may be provided to prevent the elastic latch and mateable latch from being displaced relative to each other in a direction parallel to the turning direction of the lever.

The first and second engaging walls are provided on the elastic latch and projection, respectively in the embodiment described above. However, upper and lower engaging walls may be provided on the elastic latch and the projection may be pinched between both engaging walls, thereby restraining the elastic latch and mateable latch from being displaced relative to each other. On the contrary, such engaging walls may be provided on the projection and the elastic latch may be pinched between both engaging walls.

Although the lever and cover are provided on the female connector in the embodiment described above, the present invention can be applied to a structure in which the lever and cover are provided on the male connector.

The entire disclosure of Japanese Patent Application No. 2001-155300 filed on May 24, 2001 including the specification, claims, drawings and summary is incorporated herein by reference in its entirety.

What is claimed is:

1. A lever type connector assembly including first and second connector housings having front ends and rear ends and being detachably coupled to each other at the front ends thereof, a lever having a cam groove, and an attaching member rotatably supporting said lever, said attaching member being mounted on the rear end of the second connector housing, cam pins on the first connector housing engaging said cam groove in said lever, said connector housings being regularly coupled to each other when said lever is turned from a coupling start position to a coupling completion position, said lever type connector assembly being characterized in that:

said attaching member is provided with a projection that protrudes in a coupling area in the second connector housing;

one of said projection and said lever being provided in said coupling area with an elastic latch that can restrain said lever in the coupling start position from turning to the coupling completion position by engaging said elastic latch with a mateable latch portion on the other of said projection and lever; and the first connector housing being provided with a release portion that releases said elastic latch from said mateable latch by engaging said release portion with said elastic latch when the first connector housing is advancing in said coupling area, thereby elastically deforming said elastic latch to disengage said elastic latch from said mateable latch.

2. The lever type connector assembly of claim 1, wherein at least one of said projection and said lever is provided with release prevention means for preventing said elastic latch and said mateable latch from being displaced relative to each other in a direction intersecting a deflecting direction of said elastic latch and preventing said elastic latch and said mateable latch from being released.

3. The lever type connector assembly of claim 2, wherein said elastic latch is deflectable in a direction substantially parallel to a turning direction of said lever, and wherein said release prevention means includes a first engaging portion that protrudes from said elastic latch for engaging a side surface along the deflecting direction of said projection or said lever on which said projection is provided, a second engaging portion disposed adjacent said first engaging portion, said second engaging portion protruding from said projection or said lever on which said mateable latch is provided and being able to engage a side surface along the deflecting direction of elastic latch.

4. The lever type connector assembly of claim 3, wherein said attaching member can be mounted on the second connector housing in a regular position and a reversed position, and wherein at least a pair of release portions are provided for engaging said elastic latch (66) even if said attaching member is inverted.

5. A lever type connector, comprising:

a first housing having opposite front and rear ends and having a first cam means;

a second housing having opposed front and rear ends, the front end of the second housing being mateable with the front end of the first housing;

a cover mounted to the rear end of the second housing and having a projection projecting toward the front end of the second housing;

a lever mounted to the cover for movement between a coupling start position and a coupling completion position, said lever having a second cam means engageable with the first cam means on the first housing for mating the first and second housings in response to movement of the lever to the coupling completion position, an elastic latch on the lever, the elastic latch being locked with the projection and holding the lever in the coupling start position; and releasing means on the first housing and engageable with the elastic latch when the front end of the first housing engages the front end of the second housing for deflecting the elastic latch away from the projection and enabling the lever to move to the coupling completion position.

6. The lever type connector of claim 5, wherein the releasing means is formed unitarily with the first housing.

7. The lever type connector of claim 5, wherein the second housing comprises a lever pocket for accommodating the lever, the projection and the elastic latch being engaged in the lever pocket.

8. The lever type connector of claim 5, wherein the elastic latch includes a latch projection, and wherein the projection includes a mateable latch configured for releasable locked engagement with the latch projection.

9. The lever type connector of claim 5, wherein the lever is mounted pivotally to the cover for movement about an axis.

10. The lever type connector of claim 6, wherein the elastic latch is deflectable about an axis parallel to the axis for pivoting movement of the lever.

11. The lever type connector of claim 10, further comprising means for limiting deflection of the elastic latch to the axis parallel to the axis for pivoting movement of the lever.

* * * * *